United States Patent [19]

Steiner

[11] Patent Number: 4,838,320

[45] Date of Patent: Jun. 13, 1989

[54] COTNACT BAR FOR ELECTRICAL WARP STOP MOTION

[75] Inventor: Ernst Steiner, Richterswil, Switzerland

[73] Assignee: Grob & Co. Aktiengesellschaft, Horgen, Switzerland

[21] Appl. No.: 180,109

[22] PCT Filed: Jul. 22, 1986

[86] PCT No.: PCT/CH86/00102

§ 371 Date: Mar. 18, 1988

§ 102(e) Date: Mar. 18, 1988

[87] PCT Pub. No.: WO88/00626

PCT Pub. Date: Jan. 28, 1988

[30] Foreign Application Priority Data

Jul. 22, 1986 [CH] Switzerland ..... 102/86

[51] Int. Cl.[4] ..... D03D 51/30

[52] U.S. Cl. ..... 139/351; 139/353

[58] Field of Search ..... 139/351, 352, 353, 336.1; 200/61.18, 61.13, 61.44

[56] References Cited

U.S. PATENT DOCUMENTS 3,246,091 4/1966 Koch ..... 200/61.18
3,324,899 6/1967 Stagg ..... 139/353
3,725,911 4/1973 Cook et al. .

FOREIGN PATENT DOCUMENTS 75848 4/1986 Japan ..... 139/353
428612 7/1967 Switzerland .
2048319 12/1980 United Kingdom .
2117017 10/1983 United Kingdom .

*Primary Examiner*—Henry S. Jaudon
*Attorney, Agent, or Firm*—Watson, Cole, Grindle & Watson

[57] ABSTRACT

One of the bars of a contact bar, preferably the inner bar (12) has an electrical resistance which increases linearly along its entire length and which can be scanned as measurable value at any desired point along said bar. A preferable embodiment for this purpose is a metallic conductive spiral (11) which is wound onto a body of insulating material (10). An inner bar (12) configured in such a manner is held in an outer bar (13), the upper part of which is of U-shaped cross section, whereby a layer of insulating material (14) separates said inner bar from said outer bar of U-shaped cross section. The metallic conductive spiral (11) has, compared to a solid bar, a substantially higher electrical resistance which is suited for the purpose of method of measurements according to the principle of the electrical resistance bridge in order to localize a dropped drop wire on the contact bar in the event of a warp end breakage. The ratio of resistance determined from the electrical resistance bridge between the resistance of the total length of the inner bar (12) and the resistance of the partial length of the inner bar from one end of the bar to the dropped drop wire determines the distance from one end of the bar to the dropped drop wire.

9 Claims, 3 Drawing Sheets

CONTACT BAR FOR ELECTRICAL WARP STOP MOTION

Figure 1:
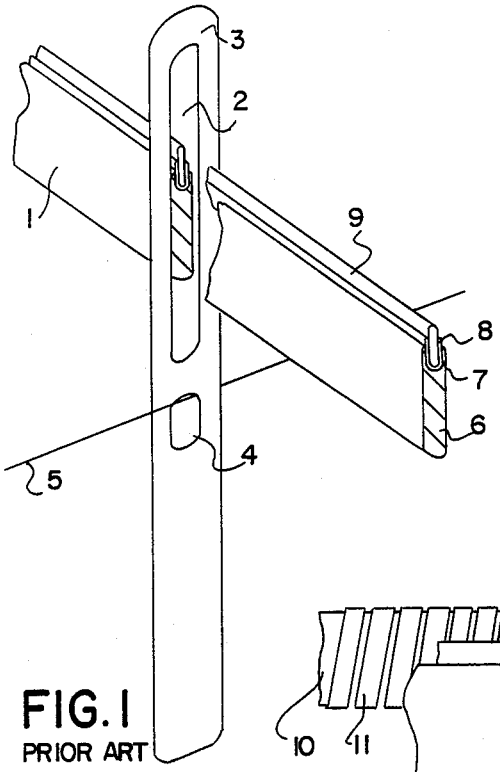
FIG. 1 PRIOR ART

The invention relates to a contact bar for an electrical warp stop motion suitable for a textile machine comprising two electrically conductive carriers arranged parallel and electrically insulated from each other. The two carriers forming the contact bar extend as one unit through the contact slots of numerous drop wires which are carried by the warp ends. If a warp end should break, the associated drop wire will drop on the contact bar and complete an electrical circuit between the two carriers, resulting in stopping of the weaving machine. Such a device of monitoring warp ends is known as electrical warp stop motion.

Most contact bars of warp stop motions in use today caomprise an inner and an outer bar. The upper edge of the inner bar is mostly configured with rectangularly shaped cut-outs which is called serration or toothing. At a breakage of a warp end, the associated drop wire drops and will be caught in one of said cut-outs. By means of a lever which is connected to the warp stop motion and also to the contact bars, the complete bars or only the inner bars can be reciprocated. This lateral movement of the contact bar with the caught drop wire in one of the cut-outs causes that the drop wires which are adjacent to the dropped drop wire are reciprocated slightly, which ultimately facilitates the location of the broken warp end.

The trend and technical development indicate clearly that weaving machines are becoming wider which subsequently necessitates longer warp stop motions. It is quite a common fact that warp stop motions now in use may have lengths of several meters. The corresponding contact bars do obviously have the same length. One warp stop motion can be equipped with several contacts bars arranged at a certain distance, the pitch, from each other and which are parallel to each other, extending across the complete length of the warp stop motion. On each of these contact bars numerous drop wires are lined up, there might be more than thousand drop wires per one contact bar, depending on the width of the weaving machine. Each drop wire is carried by an associated warp end. With increasing width of the fabrics, it becomes for the operator of a weaving machine more and more difficult and time-consuming to locate amongst several thousands of drop wires the one which dropped and rests on the contact bar. With the warp stop motions nowadays in use the location of a dropped drop wire takes place by reciprocating the contact bars which results that the drop wires which are carried by the undamaged warp ends, and are adjacent to the dropped drop wire are forming a gap, thus the broken end can be found.

The principal object of the present invention is to provide a contact bar for a warp stop motion on which it is possible to locate a dropped drop wire even on long contact bars quickly and without difficult searching operation, with the object in mind that the idle time of the weaving machine is reduced and consequently the efficiency will increase. A further principal object is to monitor the performance of weaving machines in regard to breakages of the warp ends in that the frequency and the location of warp end breakages will be registered and stored in data memories which may be evaluated in a coordinating center and may be used for various purposes.

A rather exact location of the broken warp end and the associated dropped drop wire respectively can be achieved by determining electronically the distance between the dropped drop wire and either one of the ends of the contact bar. It is known that according to the principle of the electric resistance bridge an interruption or a short circuit of current can be localized in a pair of electrical conductors. A solid bar, however, as in the present case the inner bar of the contact bar, is not suited for the purpose of scanning resistances by way of using the principle of electric resistance bridge. It is, therefore, essential to use an inner contact bar which has a substantially higher electrical, with the length linearly increasing, resistance. A thin wire would fulfil the requirements as an electrical conductive carrier because it has an adequately high resistance which is suited for the methods of measurement. A thin wire, as mentioned, can however not be suitable to take over the function of the inner bar of the contact bar in use because the rough handling prevailing in weaving sheds and the mechanical stress caused by the drop wires would be too much for said wire.

In the event of a warp end breakage, the associated drop wire drops, causing an electrical contact between the inner and outer bar which activates a release switch and stops the machine. In order to perform the mentioned method of measuring according to the principle of electrical resistance bridge, the inner bar as well as the outer bar can be used for the purpose. In order to solve the aforementiodned object, the contact bar mentioned at the beginning shows the properties as claimed in claim 1. A bar having these properties which make it possible to scan a resistance at any desired point along the length of the bar as a measurable value can have various configurations. The bar can be equipped with a body of insulating material onto which an electrical conductor is attached. Another embodiment of the bar may, however consist of one material which has the desired properties of an electrically conductive carrier, and such material can be sintered metal or carbon. An electrical conductor may have the shape of a tape and can be attached as a spiral, for instance, onto a body of insulating material. It, however, could also have the shape of a meander, or the electrical conductor can be attached to the insulating body in the shape of thin coating which can be done by method of metalizing or electro-galvanizing, etc. The embodiments of the invention define an electrically conductive carrier which has, compared to a commonly known bar, a substantially higher electrical resistance and additionally has the shape of a bar offering sufficient robustness and stability to withstand mechanical stress.

It is appropiate to use for this purpose the inner bar of a contact bar which is simple in design and which, in known warp stop motions, is kept in an outer bar of a U-shaped cross section. The cross section of the inner bar is configured as a rectangularly shaped body of insulating material onto which an electrical conductor is appropriately attached so as to form an electrical conductive carrier. The conductor is appropriately configured as a metallic conductive spiral, whereby the distance between the windings of the spiral is very narrow, however, the individual windings on the insulating body should not touch each other.

The embodiments of the invention are defined from the following description with the accompanying drawings showing:

FIG. 1:

A contact bar on which a drop wire is placed and held by a warp end in its position according to the prior art.

FIG. 2:

A cross section of a contact bar shown in FIG. 1 at an enlarged scale.

FIG. 3:

Sectional side view of a contact bar according to the invention inner bar being configured with an electrical, metallic conductor spiral.

Figure 3:
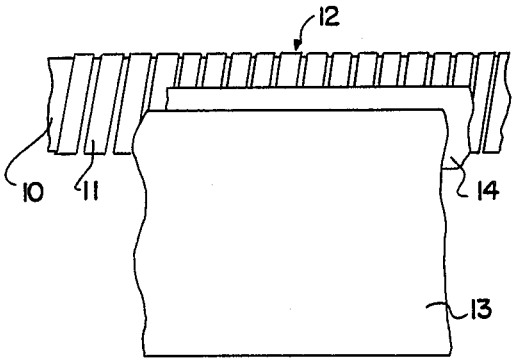

FIG. 4:

A cross section of the contact bar shown in FIG. 3.

FIG. 5:

A cross section of an inner bar at an enlarged scale having a coating acting as electrical conductor.

FIG. 6:

A cross section of an inner bar having an electrical conductor made of one material.

FIG. 7:

A cross section of an inner bar having two strip-shaped electrical conductors.

FIG. 8:

A cross section of an inner bar covered with a grid-shaped mesh, acting as an electrical conductor.

FIGS. 9, 10, 11:

Cross section, side view and top view of an inner bar with a thin conductor rail and thicker contact bodies arranged at the upper edge of the bar.

FIGS. 12–15:

Cross section, side view, top view and developed view of face side of an inner bar, having an electrical conductor in meander shape.

FIG. 16:

A contact bar in side view with drop wires and a diagrammatic view illustrating the principle of the invention to locate the dropped drop wire.

FIG. 1 shows a contact bar 1 which is in use on known warp stop motions. The bar extends through a contact slot 2 of a drop wire 3. In order to illustrate the details, the contact bar is illustrated in "broken" state. Through the thread eye 4 of the drop wire 3 a warp end 5 passes, and in the event of a breakage of the warp yarn, the drop wire 3 drops onto the contact bar 1.

Figure 2:
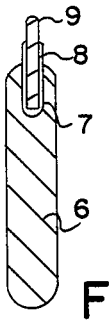
FIG. 2 PRIOR ART
Figure 4:
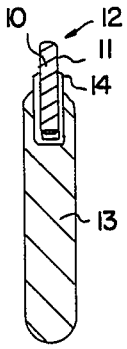

The contact bar 1 comprises an outer bar which is configured with a groove 7 on its upper edge into which, separated by a layer of insulating material 8, the inner bar 9 is held. The cross section FIG. 2, enlarged, illustrates the construction more clearly. The outer bar 6 and the inner bar 9 are electrical conductive carriers, and a dropped drop wire 3 connects them conductively, resulting in a stop of the machine. The principle of the function of the contact bar as shown in FIGS. 1 and 2 is applicable for all embodiments claimed by the invention according to FIGS. 3–16. In FIGS. 1 and 2 the details concerning the different shapes and constructions of embodiment of the inner bar are not visible. The embodiments of FIGS. 3 and 4 illustrate a body of insulating material 10, having a rectangular shaped cross section onto which a conductive, metallic spiral 11 is wound so that the individual windings having a small pitch do not touch each other. The conductive metal spiral 11 is of a tape-shaped material which preferably consists of chrome-nickel steel and which has an invariable cross section along its entire length. The length of the tape-shaped material wound on the body of insulating material 10 is substantially longer than the length of the so compared inner bar 12. An inner bar configured in such a manner as aforementioned has, compared to a solid inner bar of same length, a many times higher electrical resistence, i.e. between 20–100 Ohm. A solid bar of same length has an electrical resistance of close to zero. The inner bar consists of the body of insulating material 10 and the metallic conductive spiral 11 and form together the inner bar 12 the cross section of which is flat. The bar 12 is held in a U-shaped configuration at the upper part of the outer bar 13, and between the inner bar 12 and the outer bar 13 a layer of insulating material 14 is placed.

The distance between the windings of the conductive metallic spiral 11 is smaller than the thickness of the material of the drop wire 3 which makes sure that a dropped drop wire always makes an electrical contact between the conductive metallic spiral 11 and the outer bar 13. The inner bar 12 configured with the conductive metallic spiral 11 and the outer bar 13 each perform a conductor in an electrical circuit. This circuit will be electrically closed as soon as the inner bar 12 and outer bar 13 are electrically connected by the dropped drop wire 3, resulting in the stop of the weaving machine.

Figure 5:
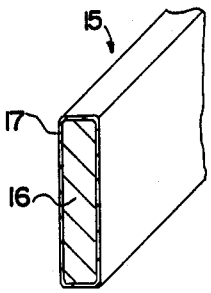

FIG. 5 shows a modified embodiment of the inner bar 15 comprising a body of insulating material 16 onto which body an electrically conductive coat 17 is applied. In order to achieve an appropiately high electrical resistance which is essential for the mentioned method of measurement, the layer of the coating 17 has to be very thin and for instance it can be made according to the metallized or galvanized process, or a thin foil can be rolled on to said insulating body. The coating may not necessarily cover the whole surface.

Figure 6:
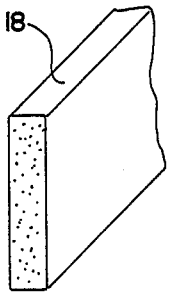

As illustrated in FIG. 6 it is possible to use a solid inner bar 18 made of an electrically conductive material as for instance sintered metal or carbon. It is also possible to use a conductive, synthetic material. An inner bar made of such material has to have a much higher electrical resistance in comparison to a metallic bar commonly used.

Figure 7:
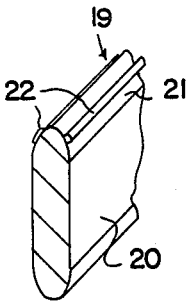

An inner bar 19 as illustrated in FIG. 7 comprises a body of insulating material 20. On its roof-shaped upper part 21 there are narrow-shaped electrical conductors 22 attached which extend along the entire length of the bar. In the event of a warp breakage the drop wire 3 drops and makes contact.

Figure 8:
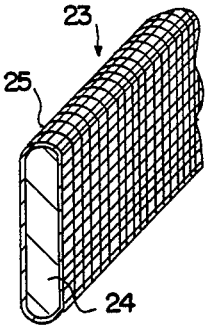

FIG. 8 illustrates an inner bar 23 consisting of a body of insulating material 24 onto which a metallic conductive grid mesh 25 is attached.

Figure 9:
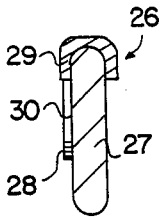
Figure 10:
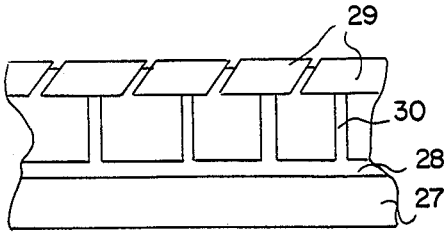
Figure 11:
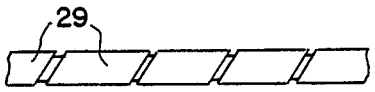
Figure 12:
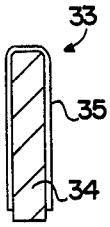
Figure 13:
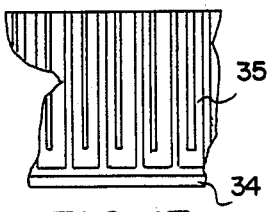

In a further embodiment as illustrated in FIG. 9–11 the inner bar 26 consists of a flat body of insulating material 27 which has on one of its longitudinal sides a thin, tape-shaped electrical conductor 28. The dropped drop wire 3 does not touch the thin conductor 28. This conductor 28 is situated in such a way that no mechanical stress applies on the conductor, and the conductor has an electrical resistance which can be scanned as a measurable value at any desired point along the entire length of the bar and is suitable for the appropiate methods of measurements. At the upper edge of the body of insulating material 27 there are contact elements 29 placed which are very closely arranged one behind the other and they have small distances between each other. The electrical conductor 28 is connected to each of these contact elements 29 by means of an electrical conductor 30 respectively. The contact elements 29 which encircle the upper edge of insulating body 27 have a larger material thickness than the one of the electrical conductor 28 and, therefore, the contact elements 29 withstand the mechanical stress. The electrical conductor 28 can, therefore, for the purpose of methods of measuring be kept very thin. In order to guarantee a proper contact with the dropped drop wire, the face sides of the individual contact elements 29 are not right-angled to the longitudinal axis, but are inclined as illustrated in the side view and top view of the bar 26 illustrated in FIGS. 10 and 11.

Figure 15:
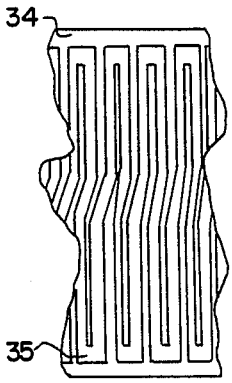
Figure 14:
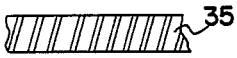

FIGS. 12–15 is a further embodiment of an inner bar 33 comprising a body of insulating material 34 onto which an electrical conductor 35 is attached. This conductor 35 is tape-shaped and has an invariable cross section. The conductor is fixed in continuous linear course both in longitudinal and transverse direction of the bar. The conductive, metallic spiral 11 which is illustrated in FIG. 3, also is fixed in a linear course both in longitudinal and transverse direction. A likewise linear course of conductor is also illustrated in the embodiment of the bar 33 in FIGS. 12–15, and this embodiment of the conductor has the shape of a meander. The object in view is always the same, to accommodate a big length of the conductor on a given length of the bar. The electrical conductor in meander-shape runs around the body of insulating material 34, with the exception of the lower, narrow side as it can be seen in the side view FIG. 13. A developed view of the outer surface of the inner bar configured with the electrical conductor forming a meander is illustrated in FIG. 15 from which it is visible that the upper, narrow face side of the bar onto which the dropped drop wire will complete a contact, the meander runs at an inclination, which can also be seen in the top view of the bar in FIG. 14, and has the same purpose as previously explained, with the aim to guarantee a contact with the dropped drop wire at any desired point along the entire length of the bar.

Figure 16:
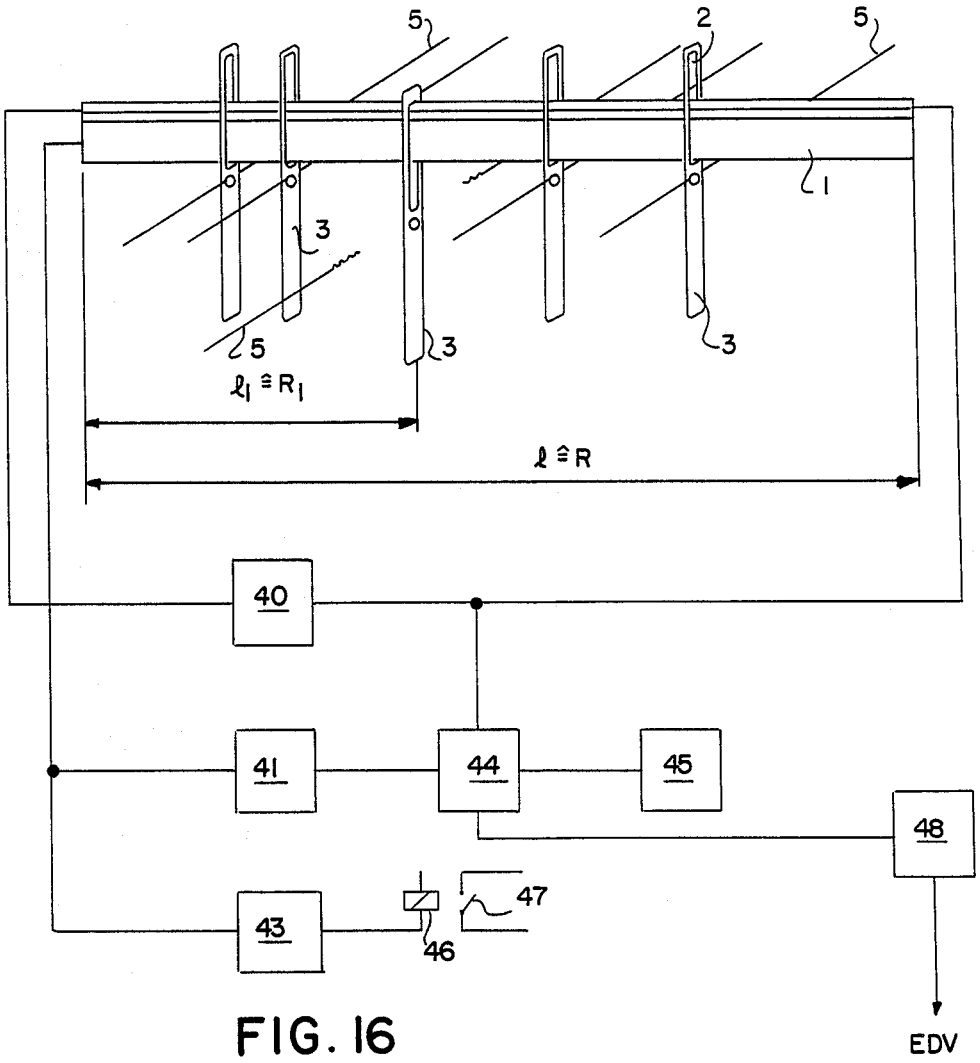

FIG. 16 illustrates schematically the principle of the method applicable to localize the dropped drop wire, contemplating the objects of the present invention of a contact bar in the event of a warp breakage. The contact bar 1 is configured as one of the embodiments illustrated in FIGS. 3–15. Furthermore, a number of drop wires 3 are illustrated, whereas under practical use these drop wires are lined up on the contact bar very densely side by side. The contact bar 1 extends through the contact slots 2 of the drop wires 3 as also illustrated in FIG. 1. Each of the warp ends 5 of the weaving machine passes through the eye 4 of the associated drop wire 3 which is carried by the warp end. One drop wire is illustrated in FIG. 16 in the dropped position and hangs on the contact bar 1 because the associated warp end broke. On a contact bar having a length of several meters and on which thousands of drop wires wires are lined up side by side, the dropped drop wire has to be localized. Since the inner bar of the contact bar as described aforementioned has an electrical resistance which increases linearly along the length of the bar, and such resistance can be scanned as a measurable value at any desired point along the entire bar, it is possible to determine a ratio of resistance between the resistance of the electrical conductive carrier extending across the entire length of the inner bar, and the resistance of this electrical conductive carrier extending from one end of the bar to the place of the dropped drop wire, i.e. a partial length of the bar. This location can be determined with the applicable principle of the electrical resistance bridge. In FIG. 16 the total length of the bar is indicated as L and has an electrical resistance R, the partial length is indicated as L1, and the associated electrical resistance as R1. The applicable method for the detemination of the ratio of the electrical resistance according to the principle of electrical resistance bridge is well known. In the electrical diagram as per FIG. 16, 40 is an electrical resistance feeder connected electrically with the inner bar of the contact bar 1, 41 is a "Sample and Hold" amplifier, 43 is an amplifier, 44 is an A/D converter and 45 is an indicating device, on which a value indicating a linear measurement in digital display is visible and which stands for the distance L1 between the end of the bar and the dropped drop wire. As a completion to this device a measuring pole or tape measure for instance may be located above the warp stop motion in order to determine the distance right from the digital display and subsequently determining the dropped drop wire and the associated broken warp end.

A dropped drop wire stops the weaving machine. A relay 46 located behind the amplifier 43 activates a switch 47 and stops the weaving machine.

Already existing digits in the display can be transmitted from the A/D converter 44 via a serial interface 48 to a data processing system. This system can for instance store data of a group of weaving machines equipped with warp stop motions and indications concerning the frequency of warp end breakages, the location where these warp end breakages take place can also be processed.

The advantages resulting from the above mentioned possibilities are at least of equal importance as the quick localization of a broken warp end.

I claim:

1. A contact bar adapted for use in an electrical warp stop motion device of a textile machine, said bar comprising two electrical conductive carriers extending parallel and being insulated from each other, and adapted to project as one assembly through contact slots of numerous drop wires of the stop motion device which are hanging from warp ends in the textile machine, said carriers capable of coming into electrical connection in the event of a breakage of one warp end by means of the associated drop wire which results, due to the electrical conection, in a switch being tripped which consequently stops the textile machine, one of said electrical conductive carriers being a body of insulating material on which an electrical conductor is provided having an electrical resistance which increases linearly along the entire length of the carrier as a measurable value at any desired point, wherein the electrical conductor has an unvarying cross section, and a substantially larger length than the lenght of the bar and is attached to a body of insulating material, and follows a line which runs continuously both in a longitudinal direction and in a transverse direction of the bar.

2. A contact bar as claimed in claim 1, wherein said electrical conductor attached on the body of insulating material has a spiral configuration.

3. A contact bar as claimed in claim 1, wherein said electrical conductor attached on the body of insulating material has a meander configuration.

4. A contact bar as claimed in claim 1, wherein said one conductive carrier is an inner bar mounted in an outer bar, said inner bar being a body of insulating material on which an electrical conductor is provided.

5. A contact bar as claimed in claim 4, wherein the inner bar comprises a flat body of insulating material and a metallic conductive spiral attached to said body, the cross-section of said spiral being unvariable and windings of said spiral do not contact each other.

6. A contact bar as claimed in claim 5, wherein the metallic conductive spiral consists of tape-shaped material.

7. A contact bar as claimed in claim 6, wherein the tape-shaped material of the metalic conductive spiral consists of chrome-nickel steel.

8. A contact as claimed in claim 4, wherein the flat metallic conductive spiral is wound on the body of insulating material, said body of insulating material and said conductive spiral are one assembly retained in a groove of an outer bar having a U-shaped cross-section and said assembly is fastened to said outer bar by glue.

9. A contact bar adapted for use in an electrical warp stop motion device of a textile machine, said bar comprising two electrical conductive carriers extending parallel and being insulated from each other, and adapted to project as one assembly through contact slots of numerous drop wires of the stop motion device which are hanging from warp ends in the textile machine, said carriers capable of coming into electrical connection in the event of a breakage of one warp end by means of the associated drop wire which results, due to the electrical connection, in switch being tripped which consequently stops the textile machine, one of said electrical conductive carriers being a body of insulating material on which an electrical conductor is provided having an electrical resistance which increases linearly along the entire length of the carrier as a measurable value at any desired point, wherein the electrical conductor is attached to one of the longitudinal sides of said body of insulating material, on which side the drop wire cannot make contact with said electrical conductor, said conductor having an electrical resistance which can be scanned at any desired point along the carrier as the measurable value, said carrier further comprising a plurality of contact bodies attached one after the other on the upper, longitudinal edge of said body of insulating material with a small distance between the adjacent bodies, said contact bodies having a larger thickness of material than the electrical conductor and said contact bodies being individually electrically connected to the electrical conductor.

* * * * *